United States Patent [19]

Compton

[11] 4,274,934

[45] Jun. 23, 1981

[54] PROCESS FOR REMOVING NITROGEN FROM SHALE OIL USING PYRROLE POLYMERIZATION

[75] Inventor: Leslie E. Compton, Claremont, Calif.

[73] Assignee: Occidental Research Corporation, Irvine, Calif.

[21] Appl. No.: 55,007

[22] Filed: Jul. 5, 1979

[51] Int. Cl.[3] ..... C07C 3/24; C10G 27/00; C10G 21/14

[52] U.S. Cl. ..... 204/162 R

[58] Field of Search ..... 204/159.22, 162 R; 208/254 R

[56] References Cited

U.S. PATENT DOCUMENTS

| | | | |
|---|---|---|---|
| 2,035,102 | 3/1936 | Stratford et al. | 208/324 |
| 2,035,583 | 3/1936 | Bailey | 546/181 |
| 2,309,324 | 1/1943 | McAllister et al. | 546/1 |
| 2,541,458 | 2/1951 | Berg | 260/705 |
| 2,741,578 | 4/1956 | McKinnis | 208/254 R |
| 2,848,375 | 8/1958 | Gatsis | 208/265 |
| 3,607,732 | 9/1971 | Boggs | 208/254 R |
| 3,719,587 | 3/1973 | Karchmer et al. | 208/208 R |
| 4,033,861 | 7/1977 | Holloway et al. | 208/254 R X |
| 4,159,940 | 7/1979 | Smith | 208/254 R |

*Primary Examiner*—Leland A. Sebastian

*Attorney, Agent, or Firm*—Christie, Parker & Hale

[57] ABSTRACT

A process for reducing the nitrogen content of shale oil by polymerizing the pyrrole compounds present in the shale oil by conditioning the shale oil with at least one of the following steps of acidifying the shale oil with a strong acid, heating the shale oil to at least about 85° C., oxygenating the shale oil with an oxygen-supplying gas, and irradiating the shale oil with actinic radiation. The resulting pyrrole polymers are insoluble in the shale oil and are separated by liquid/solid separation techniques.

11 Claims, 1 Drawing Figure

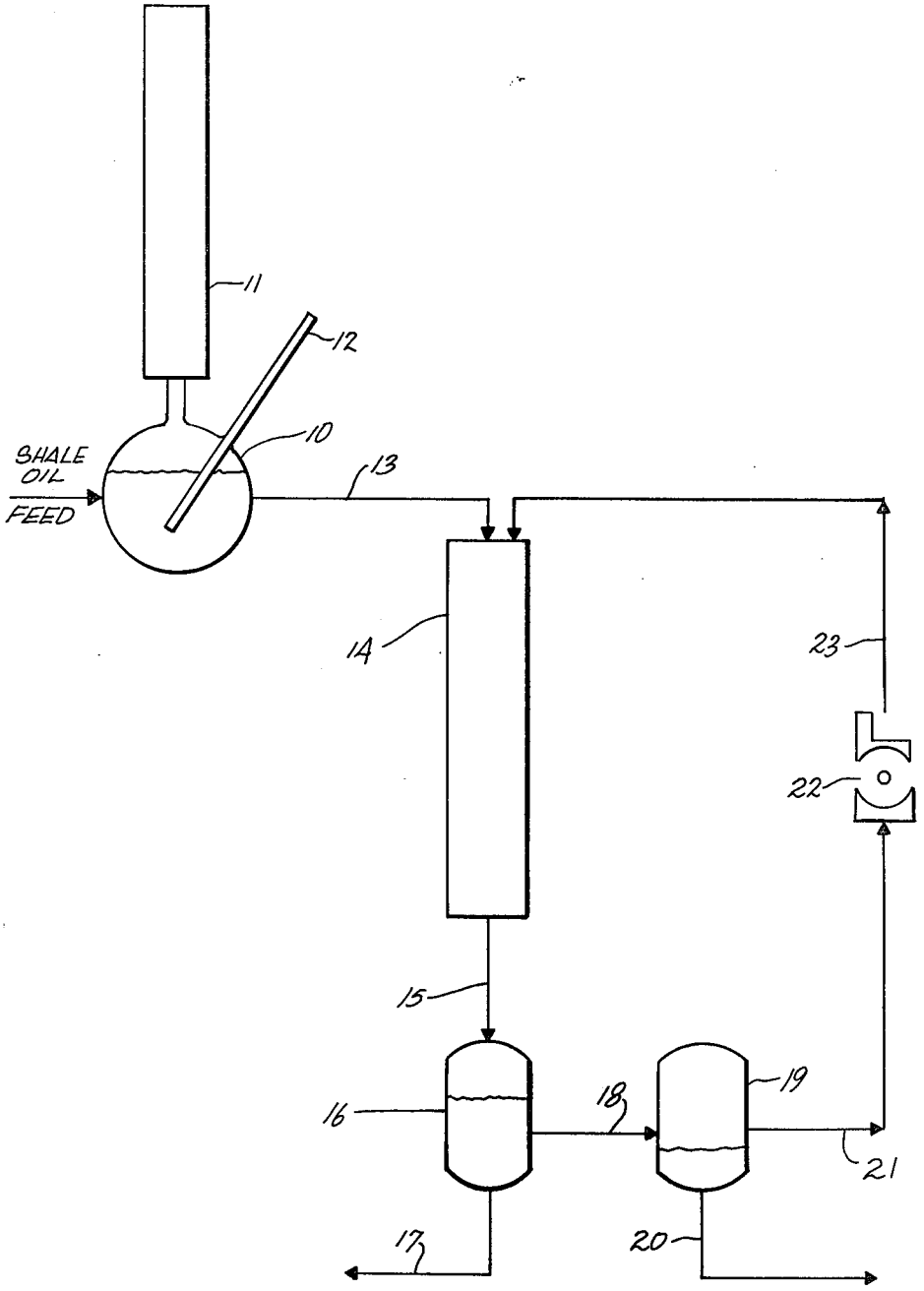
11
12
10
SHALE OIL FEED
13
14
23
22
15
16
18
19
21
17
20

PROCESS FOR REMOVING NITROGEN FROM SHALE OIL USING PYRROLE POLYMERIZATION

BACKGROUND OF THE INVENTION

This application relates to a process for the refining of shale oil and, more particularly, this application relates to a method for reducing the nitrogen content of shale oil and especially shale oil produced from an in situ oil shale retort.

The term "oil shale" as used in the industry is, in fact, a misnomer; it is neither shale nor does it contain oil. It is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil."

Kerogen is considered to have been formed by the deposition of plant and animal remains in marine and non-marine environments. Its formation is unique in nature. Alteration of this deposited material during subsequent geological periods produced a wide variety of organic materials. Source material and conditions of deposition are major factors influencing the type of final product formed.

Kerogen samples, found in various parts of the world, have nearly the same elemental composition. However, kerogen can consist of many different compounds having differing chemical structures. Some compounds found in kerogen have the structures of proteins while some compounds have structures of terpenoids, and others have structures of asphalts and bitumens.

Shale oils produced from oil shale are generally high in molecular weight, viscous organic liquids, which are predominantly hydrocarbonaceous or oxygen, nitrogen and sulfur-containing organic compounds. Shale oils are of varying linear, branched, cyclic and aromatic hydrocarbon and substituted hydrocarbon content, generally having high pour points, moderate sulfur content and relatively high nitrogen content. As a composition of shale oil depends on the composition of the kerogen within the oil shale formation, the composition of the shale oil can vary from one geographic location to another. The shale oil produced from an oil shale formation can vary also between strata within the formation. The nitrogen content of shale oil can also vary dependent on the geographical location of the oil shale deposit from which the shale oil is produced. Such a variance in nitrogen content in different geographical locations can be attributed to differences in the environment during the time of the deposition of the organisms, which upon lithification, become oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation.

The nitrogen content in shale oil is attributable to basic nitrogen-containing compounds and nonbasic nitrogen-containing compounds. The relative percentages of the basic and nonbasic nitrogen compounds comprising the total nitrogen content of shale oil can also vary depending upon the particular shale oil.

The nitrogen content of shale oil is generally up to about two percent by weight with shale oil from some deposits having greater than two percent by weight nitrogen content. The average nitrogen content of shale oil recovered by in situ retorting of oil shale from the Piceance Creek Basin of Western Colorado is generally between 1.2 and 2.0 percent by weight.

The presence of nitrogen in shale oil presents many problems. For example, nitrogen can interfere with the transportation and use of the shale oil. Deleterious effects, brought about by the presence of nitrogen in shale oil, include: decreased catalyst life in dehydrogenation, reforming, hydrocracking and catalytic cracking reactions; decreased chemical stability of products; and decreased color stability of products. Another problem with the presence of nitrogen in shale oil is that it is undesirable to transport nitrogen-containing shale oil through pipelines which are also used for transporting petroleum products because of possible pollution of such petroleum products with residual nitrogen-containing shale oil in the pipeline. Generally, such petroleum products contain a very low nitrogen content (i.e., greatly less than one percent by weight). The relatively high nitrogen content in shale oil can pollute the pipelines making them undesirable and uneconomical for transporting the low nitrogen-containing petroleum products. In addition, high nitrogen content in shale oil can reduce shale oil throughput in pipelines due to self-polymerization brought about by the reactivity of the nitrogen-containing compounds. Due to the basicity of the nitrogen-containing compounds in shale oil, some corrosion may occur in the pipeline thus causing potential damage to a pipeline which is used to transport shale oil.

Product stability is a problem that is common to many products derived from shale oil, with the major exception of the asphalt cut and those products that have undergone extensive hydrotreating. Such instability, including photosensitivity, is believed to be resultant primarily from the presence of nitrogen-containing compounds.

It is, therefore, desirable to reduce the total nitrogen content of shale oil to increase the utility, transportability, and stability of the shale oil and products derived from such shale oil.

Due to the undesirable nature of the presence of nitrogen in organic fluid streams, such as fluid streams produced in the recovery and refining of petroleum, coal and oil shale, processes have been developed to reduce the nitrogen content to an acceptable level. The level of acceptability for the nitrogen content is generally based upon the end use of the particular fluid stream. The earlier processes for reducing the nitrogen concentration generally relate to removing the basic nitrogen-containing compounds present in the fluid streams. Such processes were developed primarily in regard to the refining of petroleum as the nitrogen content in petroleum is substantially attributable to basic nitrogen-containing compounds. It should also be noted that generally the nitrogen concentration in petroleum is substantially lower than the nitrogen concentration in shale oil. For this reason, in the processing of petroleum, only a small portion of the nitrogen-containing compounds needs to be removed in order to get the total nitrogen content to an acceptable level.

U.S. Pat. No. 3,719,587 to Karchmer et al discloses a process for removing basic nitrogen-containing compounds from coal naphtha. The basic nitrogen compounds are removed by washing the naphtha with water or with a dilute aqueous solution of a strong acid, such as sulfuric acid, hydrochloric acid, phosphoric acid and acetic acid. The dilute acid solutions are from zero to ten percent by weight of the acid.

U.S. Pat. No. 2,848,375 to Gatsis also discloses a method for removing basic nitrogen compounds from organic substances. However, the process used therein is by washing the organic substances with a weak acid in combination with a polyalcohol.

U.S. Pat. No. 2,741,578 to McKinnis teaches that mineral oils can be treated to recover the basic nitrogen-containing compounds by extracting the mineral oil with a selective solvent for the nitrogen bases. The selective solvents taught in the patent are organic hydroxy compounds which have a pH greater than 6.5.

U.S. Pat. No. 2,035,583 to Bailey discloses a process for the separation and recovery of nitrogen bases from mineral oils. In this process, the mineral oils are extracted with a solvent for the basic nitrogen-containing compounds. The acceptable solvents are liquid sulfur dioxide, furfural, aniline, nitrobenzene and isobutyl alcohol. To prevent loss of valuable mineral oils in the solvent, the patent discloses that the resultant extract solution can itself be extracted with dilute aqueous acids to recover the nitrogen bases.

U.S. Pat. No. 2,035,102 to Stratford et al discloses a process for improving the color and viscosity of petroleum oils. The process comprises extracting the oil with phenol, nitrobenzene furfural or liquid sulfur dioxide in combination with an acid, such as picric acid, acetic acid, oxalic acid, citric acid and benzene sulfuric acid.

U.S. Pat. No. 2,541,458 to Berg discloses a process for recovering nitrogen bases from hydrocarbon fractions. In the process the fraction is extracted with a volatile acid or nonvolatile acid salt in combination with a mutual solvent for the acid and the hydrocarbon fraction. The mutal solvents include low boiling alcohols and ketones.

U.S. Pat. No. 2,809,324 to McAlister et al discloses a method for removing nitrogen bases from water insoluble organic solvents, mineral oils and hydrocarbon fractions. In the process a mineral oil is extracted with an aqueous, weak acid solution. The weak acids are classified as acids having dissociation constants below $10^{-3}$.

Many of these earlier processes described in the above patents do not address themselves to the removal of nonbasic nitrogen-containing compounds which can be present in the various organic fluids and which are present in shale oil, in particular, in relatively high concentrations. Additionally, many of the above described processes are not specific for treatment of shale oil and this relatively high nitrogen content found in shale oil. Still further, none of the above processes are specific for lowering the nitrogen content for shale oil produced by in situ retorting of oil shale.

SUMMARY OF THE INVENTION

The present invention is directed to a method for the refining of shale oil wherein the nitrogen content of the shale oil is reduced. The nitrogen content is reduced by polymerizing the polymerizable nitrogen-containing compounds present in the shale oil and thereafter separating the polymerized nitrogen-containing compounds from the shale oil.

Shale oil produced by the retorting of oil shale is a liquid product which predominantly contains liquid hydrocarbons and substituted liquid hydrocarbons such as nitrogen substituted hydrocarbons. The polymerizable nitrogen-containing compounds present in shale oil are polymerized by conditioning the shale oil with at least one of the following steps: treating the shale oil with a strong acid; heating the shale oil to at least about 85° C.; introducing an oxygen-containing gas into the shale oil; and irradiating the shale oil with actinic radiation to bring about polymerization.

The nitrogen-containing polymers formed are substantially insoluble in the shale oil and can be separated from the shale oil by extraction, propane deasphalting, centrifugation, filtration, plating, settling and the like. In propane deasphalting, the shale oil containing the polymerized nitrogen-containing compounds is contacted with liquid propane. The shale oil is soluble in the liquid propane and the nitrogen-containing polymers are substantially insoluble in the liquid propane. Upon propane deasphalting, there is produced a liquid propane fraction containing a reduced nitrogen-content shale oil and an asphalt fraction comprising nitrogen-containing polymers. The liquid propane fraction is subsequently treated to separate the liquid propane from shale oil such as by vaporization of the liquid propane. The vaporized propane can be recovered, liquefied and recycled for reuse in a subsequent shale oil deasphalting step.

Two fractions of shale oil are produced by the method of this invention. The first fraction is that of a reduced nitrogen-content shale oil which has greater stability than unprocessed shale oil and is easily transported. The second fraction is a high nitrogen content asphalt fraction. This asphalt fraction can be used as an asphalt due to desirable properties it possesses. The asphalt fraction has a high nitrogen content. A high nitrogen content is desirable in an asphalt because the presence of nitrogen improves the anti-stripping properties of the asphalt, enabling formation of stable cationic emulsions. The high nitrogen content provides greater reactive sites for crosslinking among the polymers and compounds within the asphalt fraction. For this reason the high nitrogen content increases the cohesive and adhesive properties of the asphalt fraction when used as an asphalt for coating surfaces, such as roads.

BRIEF DESCRIPTION OF THE DRAWING

For a better understanding of this invention reference should be made to the accompanying drawing which is a flow diagram of the steps in a preferred method of practice of the process of this invention.

DETAILED DESCRIPTION OF THE INVENTION

The process described herein relates to the refining of shale oil and, more particularly, to the reduction of the nitrogen content of shale oil and especially the reduction of the nitrogen content of shale oil produced from the in situ retorting of oil shale.

As used herein, the term "crude shale oil" refers to the liquid product that is recovered from the retorting of oil shale. The term encompasses liquid products formed during the retorting of oil shale either through above ground retorting processes or in situ retorting processes, which liquid products have not undergone any further processing other than water removal or emulsion breaking. The term "processed shale oil" is used herein to indicate a crude shale oil which has undergone some processing such as, for example, sulfur removal, fractionation and the like. As used herein, the term "refined shale oil" refers to a crude shale oil or a processed shale oil which has been processed through the method of this invention to reduce the nitrogen content of such shale oil. The "refined shale oil," therefore, has a lower nitrogen content than either the crude shale oil or processed shale oil undergoing the method herein disclosed.

In a preferred practice of this method, the method is utilized for refining shale oil produced from in situ retorting oil shale. An in situ oil shale retort can be formed by many methods, such as the methods disclosed in U.S. Pat. Nos. 3,661,423; 4,043,595; 4,043,596; 4,043,597 and 4,043,598, all of which are incorporated herein by this reference.

Briefly, in preparing as in situ oil shale retort, formation from within the boundaries of the retort site is excavated to form at least one void, leaving a remaining portion of unfragmented formation within the boundaries of the retort being formed. The remaining portion of unfragmented formation is explosively expanded toward such a void to form a fragmented permeable mass of formation particles containing oil shale within the retort boundaries.

After the fragmented mass is formed, the final preparation steps for producing liquid and gaseous products are performed. These steps include establishing means for providing a processing gas flow to the fragmented mass formed and establishing means for withdrawing the liquid and gaseous products produced.

During retorting operations, generally the formation particles at the top of the fragmented mass are ignited to establish a combustion zone. An oxygen-supplying gas, such as air, is introduced to the combustion zone. The oxygen-supplying gas introduced to the fragmented mass maintains the combustion zone and advances it downwardly through the fragmented mass. Combustion gas produced in the combustion zone passes through the fragmented mass establishing a retorting zone on the advancing side of the combustion zone wherein kerogen in the fragmented mass is converted to liquid and gaseous products. As the retorting zone moves downwardly through the fragmented mass, liquid and gaseous products are released from the fragmented formation particles. The liquid and gaseous products are collected from the lower end of the fragmented mass.

Although the process disclosed herein of reducing the nitrogen content of shale oil is primarily discussed in relation to shale oil produced from the in situ retorting of oil shale, the process can be practiced on shale oil produced by other methods of retorting. Many of these methods for shale oil production are described in *Synthetic Fuels Data Handbook,* compiled by Dr. Thomas A. Hendrickson and published by Cameron Engineers, Inc., Denver, Colo. For example, other processes for retorting oil shale include those known as the Tosco, Paraho Direct, Paraho Indirect, N-T-U and Bureau of Mines, Rock Springs, processes.

The nitrogen content of shale oil is attributable to such nitrogen-containing compounds as pyridines, quinolines, acridines, amines, pyrroles, indoles and carbazoles. A relatively high fraction of the nitrogen content is due to the nonbasic nitrogen-containing compounds having a pyrrole structure. The nitrogen-containing compounds that are pyrroles and pyrrole-containing compounds are hereinafter referred to collectively as "pyrroles."

The pyrrole compounds include such compounds as pyrroles, indoles, carbazoles, substituted pyrroles, substituted indoles, substituted carbazoles and the like. These pyrrole compounds are sufficiently nonbasic that they are substantially insoluble in mineral acids.

The pyrroles present in shale oil are derivatives of plant pigments that were involved originally in photosynthesis processes and which had a porphyrin ring, base molecular structure. The pyrrole compounds present in crude shale oil and processed shale oil are a result of the decomposition of these various porphyrin ring structures. Such decomposition of the prophyrin ring-structured molecules occurred upon deposition or after the layers of organic matter were deposited. Additionally, decomposition of the porphyrin ring-structured molecules occurs during the retorting of the oil shale. For example, the porphyrin ring-structured molecules can be cracked during the retorting process in the combustion or retorting zones.

Other nitrogen-containing compounds present in shale oil, such as pyridines, quinolines, acridines and amines, are sufficiently basic in nature that they can be easily protonated in acidic solutions. Generally, these basic nitrogen-containing compounds can be removed from the shale oil by extracting the shale oil with a weak acid. Some nitrogen-containing compounds, although possessing basic properties with regard to the nitrogen-containing moiety, are not extractable using acids because of the organic or oil functionality of the remainder of the compound. For example, long-chain, nitrogen-containing compounds may not be extracted if the basic functionality is small in comparison to the hydrocarbon functionality. The pyrrole compounds, however, are not extracted by an acid extraction as the pyrrole compounds are not soluble nor easily protonated by an acidic solution.

In considering reducing the total nitrogen content of shale oil, one can perform the successive steps of extracting the shale oil to reduce the basic nitrogen-containing compounds and then decreasing the nitrogen content by feeding the extracted shale oil (a processed shale oil) into the method herein described as a feed stream. The combination of removing basic nitrogen-containing compounds and polymerizable nonbasic nitrogen-containing compounds is desirable to decrease the total nitrogen content of shale oil to a level which makes the shale oil competitive with petroleum oil and enhances transportability of the shale oil.

The extraction of shale oil with an acid generally does not significantly decrease the nitrogen content of the shale oil to an acceptable level. The extraction with an acid is insufficient because of nonbasic nitrogen-containing compounds present in shale oil, and because of the lack of solvating effect of acid extraction on nitrogen-containing compounds having an organic or hydrocarbonaceous functionality which overcomes the basic functionality of the nitrogen-containing moiety. The nitrogen content attributable to pyrrole compounds remains sufficiently high after an acid extraction to be undesirable in a shale oil product.

Pyrrole compounds are chemically reactive and are generally unstable in the presence of a strong acid, oxygenated environments, heated environments and when irradiated with actinic radiation sufficient to initiate polymerization of the pyrrole compounds. Generally, such actinic radiation can have a wavelength equal to or shorter than light within the visible solar spectrum. Instability of the pyrrole compounds toward actinic radition is believed attributable to such compounds origin from the chromophores of the plants deposited to form the oil shale. The pyrrole compounds are considered unstable because they tend to polymerize forming insoluble polymers. It is this instability in forming insoluble polymers which is used in order to separate these nitrogen-containing compounds from shale oil.

Polymerization of the polymerizable pyrrole compounds can be brought about by conditioning the shale oil with at least one of the following steps such as acidifying the shale oil with a strong acid, heating the shale oil to at least 85° C., oxygenating the shale oil by introducing an oxygen-supplying gas to the shale oil, and irradiating the shale oil with actinic radiation of sufficient energy to bring about polymerization. Various combinations of these steps can also be used to bring about polymerization.

The shale oil is conditioned with a strong acid, such as hydrochloric acid, sulfuric acid, phosphoric acid, sulfonic acid and substituted sulfonic acid, such as chlorosulfonic acid and trichlorosulfonic acid and the like for bringing about polymerization of the pyrrole compounds present in the shale oil. A sufficient amount of acid is added to acidify the shale oil. The polymers formed are substantially insoluble in the acidic shale oil medium. As the polymers are insoluble in the shale oil, they can be readily separated from the shale oil by any convenient method, such as by filtration, settling, centrifugation, extraction and the like. The shale oil can be separated from the insoluble polymers by solvating the shale oil in liquid propane, then separating the liquid propane fraction from the insoluble polymers. Utilizing liquid propane, sometimes referred to herein as propane deasphalting, beneficially results in less shale oil loss in the insoluble polymer fraction and provides good separation of the polymers from the desired shale oil.

Polymerization of the pyrrole compounds present in shale oil by the process herein is accomplished by utilizing the instability of the pyrrole compounds and then affecting this instability to solidify and bring the pyrrole compounds out of solution as polymers. The use of a strong acid to effect instability and polymerize the pyrrole compounds breaks down the resonance energy of the pyrrole compounds, making them more unstable in solution and thus bringing about polymerization. The resonance of the compound is broken down by the proton from the acid being drawn into the electron cloud of the pyrrole structure. The proton's affinity for electrons within the cloud ties up the electrons and destroys the resonance of the structure. Acid conditioning can be preferred over heating to polymerize the pyrrole compounds for there is no energy input requirement for the acid conditioning. The addition of a strong acid can also be beneficial in that it can also serve to remove the basic nitrogen compounds present in shale oil. The addition of acid can also be useful if a later processing of the shale oil requires acidification of the shale oil. Acid conditioning can affect other compounds other than the pyrrole compounds present. These "other compounds" affected can differ from the "other compounds" affected by other conditioning steps, such as heating, oxygenating and irradiating.

Polymerization of the pyrrole compounds can also be brought about by heating shale oil containing such compounds. It has been found that heating shale oil to a temperature of at least 85° C. polymerizes the pyrrole compounds in a time period which is useful and economically feasible in a production process. Generally, such a time period is up to about 100 hours. Heating the shale oil for longer than 100 hours provides no significant increase in pyrrole polymerization than when heating for 100 hours. Economically preferred heating time periods from about five to ten hours provide substantial polymerization of the pyrrole compounds. Temperatures greater than 85° C. can be used to polymerize the pyrrole compounds. As the temperature is increased, the rate of the polymerization reaction is also increased. Additionally, conducting the polymerization reaction at higher temperatures, such as near the boiling point of the shale oil, can bring about other reactions which are undesirable in this early stage of processing the shale oil. Polymerization of the pyrrole compounds can occur at temperatures less than 85° C.; however, at such temperatures the reaction rate is sufficiently slow that the polymerization process proves uneconomical.

Heating the shale oil to bring about polymerization of the pyrrole compounds utilizes the heat energy input to affect the stability of the pyrrole compounds. The step of heating the shale oil provides a generally inexpensive and easy to engineer processing step. The heating of the shale oil to polymerize the pyrrole compounds can also be beneficial to provide a preheating of the shale oil for subsequent processing wherein it is necessary to heat the shale oil. For example, the heating step herein can be useful as a preheating step for a process for reducing the sulfur content of the shale oil by thermal reaction wherein the shale oil is heated to temperatures from about 100° to about 400° C.

The pyrrole compounds can also be polymerized by oxygenating the crude shale oil. The shale oil containing nitrogen-containing compounds, such as pyrrole compounds, can be oxygenated by introducing oxygen or an oxygen-containing gas into the polymerization reaction vessel. A preferred oxygen-supplying gas which polymerizes the pyrrole compounds present in shale oil is air. Air is preferred because it is readily available, inexpensive and contains sufficient oxygen to bring about polymerization of the pyrrole compounds. Polymerization of the pyrrole compounds using oxygenation of the shale oil can be enhanced by oxygenating the shale oil at elevated tempertures, such as temperatures above 85° C. Raising the temperatures of the oxygenation process increases the rate of the polymerization reaction. Also, the polymerization brought about by oxygenation can be enhanced by oxygenating shale oil which has been conditioned with a strong acid, as hereinbefore defined.

Oxygenating the shale oil to bring about polymerization differs from the heating step in that it is not an energy input step. Most compounds present in shale oil are not affected by oxygenation. Pyrrole compounds are reactive with oxygenation, even at moderate temperatures, such as room temperature. Oxygenation differs from the acid conditioning step in that oxygenation is more specific to the pyrrole compounds and the reaction mechanism differs from that of acid conditioning. Oxygenation can be a preferred processing step when the pyrrole compounds are being singled out, as the nitrogen-containing compounds to be removed from a shale oil or when it is undesirable to add an acid or to heat the total mass of shale oil.

The polymerization of the pyrrole compounds present in shale oil can be brought about by supplying energy other than heat energy to the shale oil. For example, energy can be supplied to the shale oil in the form of actinic irradiation. The shale oil is irradiated with actinic radiation for a time sufficient to bring about polymerization of the pyrrole compounds. Actinic radiation can be any radiation within the electromagnetic spectrum that is capable of polymerizing the pyrrole compounds. Generally, such actinic radiation is of a wavelength equal to or shorter than the wavelengths for light within the visible portion of the solar spectrum. Preferred actinic radiation is ultraviolet (UV) radiation. Ultraviolet light is preferred as UV sources are readily available and it is less hazardous than the use of other radiation such as X-rays. Due to the dark nature of shale oil and its low light transmittance properties, it is generally necessary to agitate the shale oil as it is being irradiated. Agitation affords the greatest probability of the irradiation encountering the pyrrole compounds. Thus, the time of irradiation is also dependent upon the agitation of the shale oil. Irradiation can be combined with the other conditioning steps of acidifying, oxygenating and heating in order to enhance pyrrole polymerization.

Irradiation of the shale oil is similar to the heating step in that it is an energy input step. However, irradiation differs from the heating step in that irradiation is more specific to polymerizing pyrrole compounds than is heating. Although there are other photosensitive compounds present in shale oil, the pyrrole compounds are especially receptive to photons. The compounds present in shale oil that are thermally sensitive, while including the pyrrole compounds, are not necessarily the same compounds that are photosensitive.

After the pyrrole compounds have been polymerized they are separated from the shale oil. The pyrrole polymers are substantially insoluble in the shale oil and, therefore, can be separated from the shale oil by any convenient method for separating solids from liquids, such as by decantation centrifugation, plating, settling, filtration extraction and the like.

A preferred method of separating the polymers is by propane deasphalting. This process is preferred because a continuous operation of separating the polymers from the shale oil can be conducted. In propane deasphalting, the conditioned shale oil, which has been conditioned either by adding a strong acid, heating, oxygenating, irradiating or combinations thereof, is contacted with liquid propane. The liquid propane extracts the shale oil and leaves a raffinate containing the pyrrole compound polymers. Propane deasphalting is also preferred over other solids/liquid separation processes because of the selective solvating properties of the liquid propane for the shale oil. That is, the liquid propane exhibits a strong affinity for the shale oil, thus reducing the loss of shale oil during the separation process by substantially reducing the amount of shale oil which is retained in the pyrrole polymer raffinate.

The shale oil extracted by the liquid propane can be separated from the liquid propane by any convenient method, such as by vaporization of the liquid propane from the shale oil leaving a processed shale oil having a substantially lower nitrogen content than the initial shale oil feed. The propane vaporized from the propane shale oil mixture can be recovered and liquefied for further use in a subsequent extraction step.

The process of polymerizing pyrrole compounds present in shale oil can decrease the nitrogen content of shale oil to a range of about 1.0 to about 1.3 weight percent in the processed shale oil. A reduction to this range represents about a 20 to 40 percent reduction of the total nitrogen content in shale oil.

With reference to the drawing, the overall process is illustrated. A shale oil feed is introduced into a reaction chamber 10 wherein polymerization occurs. The shale oil feed stream to the reaction vessel 10 can be a crude shale oil feed or a processed shale oil feed. Preferably, the feed stream to the reaction vessel 10 is a crude shale oil. Treating a crude shale oil for reducing the nitrogen content therein enhances subsequent processing steps conducted on the shale oil, such as cracking, hydrocracking, hydrogenating and the like. Polymerization is brought about by conditioning the shale oil with an acid, oxygenating, heating or irradiating the shale oil or by combinations of these processes.

The reaction vessel 10 can be equipped with a reflux condenser 11 for returning volatile products to the reaction chamber. An air sparger 12 is fitted to the reaction chamber for introducing oxygen-supplying gas to the shale oil if oxygenation is to be used in polymerizing the pyrrole compounds.

The conditioned shale oil 13 is transferred to an extraction column 14 wherein the conditioned shale oil containing the pyrrole compound polymers is extracted with liquid propane. The liquid propane and shale oil/-polymer mixture stream 15 is fed to separator 16 wherein the pyrrole compound polymers are separated and removed as an asphalt fraction stream 17. The raffinate stream 17 containing the pyrrole compound polymers is removed from the separator 16. This raffinate contains a relatively high concentration of nitrogen and because of its solids content can be used as an asphalt for repairing and paving surfaces.

The liquid shale oil and propane mixture is removed from the separator as stream 18 and fed into a depressurization chamber 19 wherein the liquid propane is volatilized from the shale oil. The refined shale oil is removed through line 20. The volatilized propane is removed by stream 21 and repressurized by pump 22 to liquid propane. The liquid propane is recycled by stream 23 to the extractor 14 for extracting additional shale oil values from conditioned shale oil.

The invention is further illustrated by the following examples.

EXAMPLE 1

A crude shale oil having a nitrogen content of about 1.55 percent by weight is fed into a reaction vessel. The reaction vessel is equipped with a reflux condenser and heating mantle. The reaction vessel is also equipped with means for introducing an oxygen-containing gas into the shale oil.

The shale oil in the reaction vessel is heated to a temperature of about 85° C. When the temperature of the shale oil reaches 85° C., oxygen is introduced. The oxygen is introduced by bubbling air through the shale oil for about five hours retaining the temperature of the shale oil at about 85° C. for this period. During this time a dark-colored solid is formed which comprises polymers of the pyrrole compounds.

After the five hour polymerization reaction, the crude shale oil is extracted with liquid propane in an extraction column. The liquid propane extracts the shale oil and leaves the nitrogen-containing polymers remaining. The liquid propane fraction containing the conditioned shale oil is sent to a depressurization vessel for recovery of the liquid propane and separation of the liquid propane from the conditioned shale oil. In the depressurization vessel, the liquid propane is volatilized leaving the conditioned shale oil as a liquid. The liquid shale oil has a nitrogen content of about 1.25 percent by weight. This represents a reduction in the nitrogen content in the initial shale oil of about 17 percent.

The volatilized propane is recovered and repressurized to liquid propane.

The raffinate separated by the propane deasphalting step contains the pyrrole compound polymers. The raffinate has a nitrogen content of about five percent by weight.

EXAMPLE 2

A crude shale oil containing about 1.7 percent by weight nitrogen is introduced into a reaction vessel. The reaction vessel is equipped with a reflux condenser and a means for introducing an oxygen-containing gas in the liquid shale oil.

Sulfuric acid is added to the crude shale oil in the polymerization reaction vessel. Air is introduced into the crude oil and acid mixture for about three hours. During this three-hour period dark-colored solids appear in the shale oil. The dark-colored solids comprise polymers containing the pyrrole compounds present in the shale oil.

The solid polymers are separated from the shale oil by extracting the shale oil with liquid propane. The liquid propane extracts the shale oil leaving remaining the polymers. The raffinate containing the pyrrole compound polymers is separated from the liquid propane fraction.

The liquid propane fraction containing the shale oil is transferred to a depressurization vessel wherein the liquid propane is separated from shale oil. The liquid propane is separated from the shale oil by volatilizing the liquid propane from shale oil. The volatilized liquid propane is repressurized forming liquid propane.

The processed shale oil has a nitrogen content of about 1.1 percent by weight. The raffinate containing the pyrrole compound polymers has a nitrogen content of about 6 percent by weight. This raffinate fraction can be used as an asphalt due to its polymeric nature, solids content, and its high nitrogen content.

EXAMPLE 3

The experiment of Example 1 is repeated in all essential details except the initial crude shale oil has a nitrogen content of 1.50 percent by weight. The polymerization reaction is conducted by oxygenating the shale oil by bubbling oxygen through the crude shale oil at a temperature of about 85° C. for 5½ hours. At the end of the 5½ hour period a fine, black precipitate appears in the oxygenated shale oil.

Analysis of the filtered processed shale oil gives a nitrogen content in the shale oil of about 1.35 percent which represents a reduction of about ten percent from the initial crude shale oil.

EXAMPLES 4–6

The following Table lists the conditions of each of the experiments conducted. In all of the examples the crude shale oil had an initial nitrogen content of 1.50 percent by weight. In Example 4 the crude shale oil was heated to about 85° C. In Example 5 the crude shale oil was heated and oxygen was introduced as described in Example 1. In Example 6 the crude shale oil was acifified to a pH of 4.6, heated to about 85° C. and oxygen was introduced. The Table lists the results of the experiments in the examples.

TABLE

| | Example 4 Heat Alone | Example 5 Heat, $O_2$ | Example 6 Heat, $O_2$, and pH = 4.6 |
|---|---|---|---|
| Wt. of oil, initial (g) | 65.17 | 86.17 | 65.97 |
| Wt. loss during reaction (g) | 0.81 | 3.17 | 6.27 |
| Percent wt. loss | 1.24 | 3.68 | 9.50 |
| Wt. of solid residue (g) | 2.85 | 5.34 | 6.49 |
| Weight Percent Solids | 4.37 | 6.20 | 9.84 |
| Wt. percent N in oil filtrate | 1.58 | 1.52 | 1.53 |
| Wt. percent N in soluble residue | 1.43 | 1.51 | 1.57 |
| Wt. percent N in insoluble precipitate | 6.84 | 6.16 | 5.64 |
| Wt. percent N in oil after propane deasphalting | 1.15 | 1.07 | 1.10 |

What is claimed is:

1. A process for reducing the nitrogen content of shale oil comprising polymerizing nitrogen-containing compounds selected from the group consisting of pyrroles, indoles, carbazoles and pyrrole-containing compounds by the steps of:

conditioning the shale oil by heating the shale oil to at least about 85° C., or oxygenating the shale oil with an oxygen-supplying gas, or irradiating the shale oil with actinic radiation for forming nitrogen-containing polymers that are insoluble in the shale oil; and separating the shale oil from the insoluble polymers.

2. A process as recited in claim 1 wherein the conditioning step comprises heating the shale oil to at least about 85° C. for a sufficient time to form insoluble nitrogen-containing polymers.

3. A process as recited in claim 1 wherein the conditioning step comprises introducing sufficient oxygen-supplying gas into the shale oil for a sufficient time to form insoluble nitrogen-containing polymers.

4. A process as recited in claim 1 wherein the conditioning step comprises heating the shale oil to at least about 85° C. and introducing an oxygen-supplying gas into the heated shale oil.

5. A process as recited in claim 1 wherein the conditioning step comprises irradiating the shale oil with actinic radiation.

6. A process as recited in claim 5 wherein the actinic radiation is from the ultraviolet region of the spectrum.

7. A process as recited in claim 5 further comprising the step of agitating the shale oil while the shale oil is irradiated with actinic radiation.

8. A process for removing pyrroles, indoles and carbazoles from shale oil comprising:

heating the shale oil to at least about 85° C.;

introducing an oxygen-supplying gas into the heated shale oil, for forming polymers of the pyrroles, indoles and carbazoles present in the heated shale oil;

contacting the shale oil with liquid propane for dissolving the shale oil and leaving the polymers of the pyrroles, indoles and carbazoles undissolved;

separating the liquid propane and shale oil from the undissolved polymers; and separating the propane from the shale oil.

9. A process for removing pyrroles, indoles and carbazoles from shale oil comprising:

irradiating shale oil with actinic radiation for forming polymers of pyrroles, indoles and carbazoles present in the shale oil;

contacting the shale oil with liquid propane for dissolving the shale oil and leaving the polymers of pyrroles, indoles and carbazoles undissolved;

separating the liquid propane and shale oil from the undissolved polymers; and separating the propane from the shale oil.

10. A process as recited in claim 8 or 9 wherein the propane is separated from the shale oil by vaporizing the propane from the shale oil.

11. A process as recited in claim 10 further comprising, after separating the propane from the shale oil, the steps of condensing the propane to liquid propane and recycling the liquid propane as a solvent for shale oil in a subsequent separating step.

* * * * *